US006216645B1

(12) United States Patent
Bobretzky et al.

(10) Patent No.: US 6,216,645 B1
(45) Date of Patent: Apr. 17, 2001

(54) METHOD FOR CONTROLLING A COOLANT PUMP OF AN INTERNAL COMBUSTION ENGINE

(75) Inventors: Peter Bobretzky, Aschach/Steyr; Harald Pastleitner, Steyr, both of (AT)

(73) Assignee: TCG Unitech Aktiengesellschaft, Kirchdorf/Krems (AT)

( * ) Notice: Subject to any disclaimer, the term of this patent is extended or adjusted under 35 U.S.C. 154(b) by 0 days.

(21) Appl. No.: 09/429,318

(22) Filed: Oct. 28, 1999

Related U.S. Application Data

(63) Continuation of application No. 09/120,309, filed on Jul. 22, 1998, now abandoned.

(30) Foreign Application Priority Data

Jul. 23, 1997 (AT) ..... 1251/97

(51) Int. Cl.[7] ..... F01P 5/14
(52) U.S. Cl. ..... 123/41.15; 123/41.02
(58) Field of Search ..... 123/41.44, 41.02, 123/41.15, 25 Q, 198 C, 198 D

(56) References Cited

U.S. PATENT DOCUMENTS

| | | | | |
|---|---|---|---|---|
| 4,669,426 | * | 6/1987 | Hirano et al. | 123/41.15 |
| 4,828,088 | * | 5/1989 | Mohan et al. | 192/58 B |
| 4,843,288 | * | 6/1989 | Volz et al. | 318/599 |
| 4,955,431 | * | 9/1990 | Saur et al. | 123/41.44 |
| 4,977,862 | * | 12/1990 | Aihara et al. | 123/41.12 |
| 5,036,803 | * | 8/1991 | Nolting et al. | 123/41.1 |
| 5,079,488 | * | 1/1992 | Harms et al. | 123/41.02 |
| 5,356,266 | * | 10/1994 | Jensen et al. | 417/45 |
| 5,390,632 | * | 2/1995 | Ikebe et al. | 123/41.02 |
| 5,506,484 | * | 4/1996 | Munro et al. | 318/599 |
| 5,529,114 | * | 6/1996 | Hall et al. | 165/41 |
| 5,577,890 | * | 11/1996 | Nielsen et al. | 417/44.2 |
| 5,627,758 | * | 5/1997 | Lansberry et al. | 364/481 |

FOREIGN PATENT DOCUMENTS

| | | |
|---|---|---|
| 37 02 947 | 8/1988 | (DE) . |
| 0 771 065 | 5/1997 | (EP) . |

OTHER PUBLICATIONS

Patent Abstracts of Japan, vol. 007, No. 044 (M–195), Feb. 22, 1983 of JP 57 193716 to Mazda Motor Corp., entitled "Cooler for Engine".

Patent Abstracts of Japan, vol. 010, No. 257 (M–513), Sep. 3, 1986 of JP 61 083423 to Nissan Motor Co., Ltd., entitled "Pump–Anomaly Diagnosing Apparatus . . . ".

* cited by examiner

*Primary Examiner*—Marguerite McMahon
*Assistant Examiner*—Jason Benton
(74) *Attorney, Agent, or Firm*—Dykema Gossett PLLC

(57) ABSTRACT

In an electrically driven coolant pump with an electromotor-pump unit an electronic control unit, generates a pulse-width modulated control signal for the pump depending on at least one engine operating parameter. In order to recognize irregularities and malfunctions in the pump's operation in due time, the control unit is connected with an error detector for the recognition of abnormal control signals and pump operating conditions and with a speed controlling device for the pump speed, with the error detector having an emergency device for the coolant pump.

11 Claims, 1 Drawing Sheet

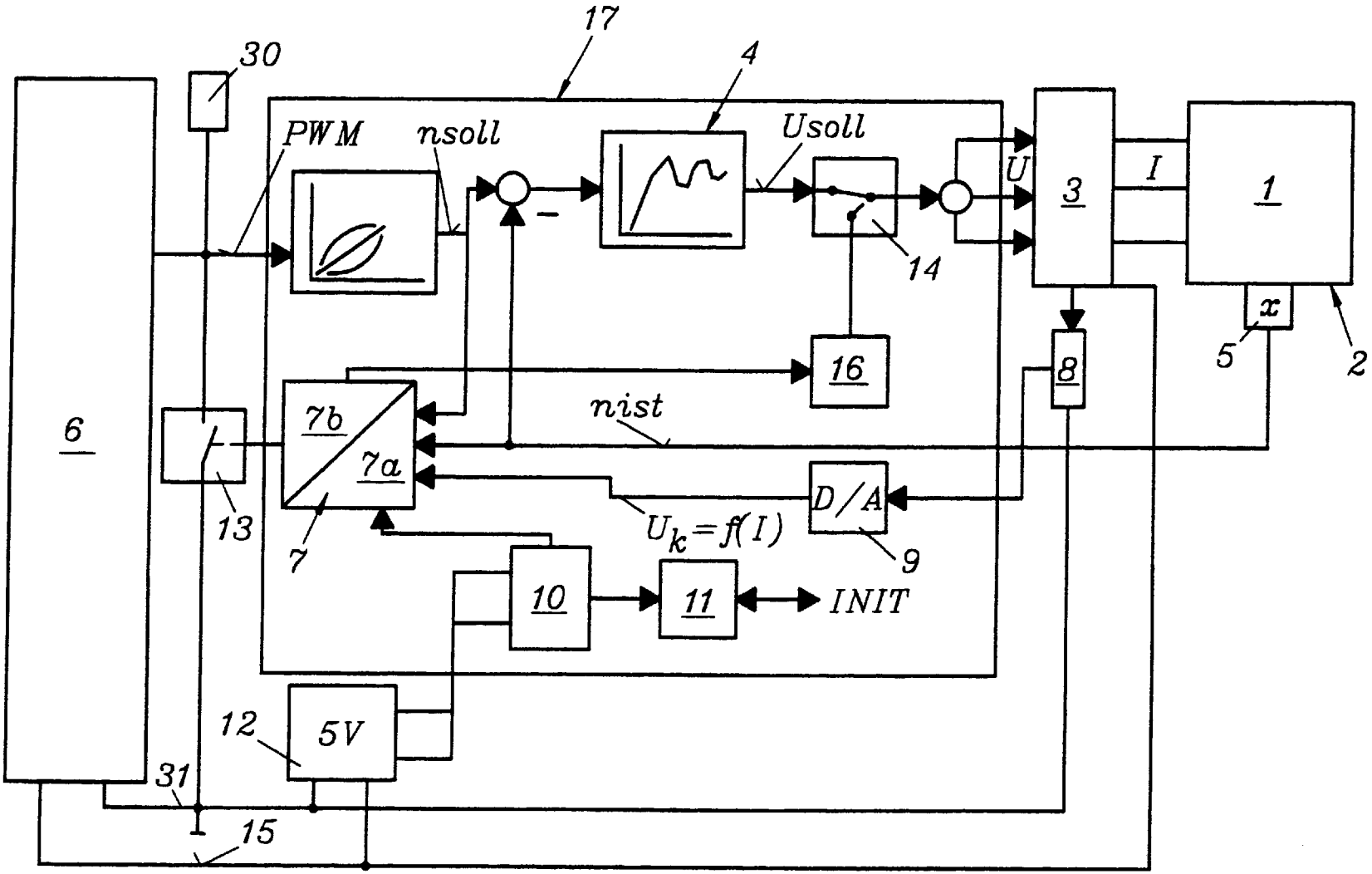
1
2
x
5
I
3
8
U
14
16
D/A
9
INIT
Usoll
4
11
$U_k = f(I)$
nist
17
10
nsoll
7a
7b
7
5V
PWM
30
13
12
15
31
6

METHOD FOR CONTROLLING A COOLANT PUMP OF AN INTERNAL COMBUSTION ENGINE

CROSS-REFERENCE TO RELATED APPLICATION

This application is a continuation of application Ser. No. 09/120,309, filed Jul. 22, 1998, now abandoned.

BACKGROUND OF THE INVENTION

The invention relates to a method for controlling a coolant pump of an internal combustion engine, with the amount of heat to be discharged being determined from at least one engine operation parameter and a control signal for the scheduled rotational speed of the coolant pump being generated by means of pulse-width modulation depending on the amount of heat to be discharged. The invention further relates to an electrically driven coolant pump for an internal combustion engine, with an electromotor-pump unit and an electronic control unit for determining a pulse-width modulated control signal for the pump depending on at least one engine operation parameter.

DESCRIPTION OF THE PRIOR ART

From U.S. Pat. No. 4,836,147 an electrically driven coolant pump of the aforementioned kind has become known whose electronically commutated d.c. motor is controlled by pulse-width modulation of an electronic control unit depending on the temperature of the internal combustion engine. In this way the coolant throughput can be adjusted to the requirements by changing the pump speed.

U.S. Pat. No. 5,529,114 shows a coolant pump for motor vehicles with a speed controlling device whose speed signal is generated by pulse-width modulation depending on operating parameters of the motor. Protection from overload for the pump motor of the coolant pump is provided by current strength and voltage limitation. The patent discloses neither an error detector nor an emergency program in the event of an erroneous signal value.

U.S. Pat. No. 5,309,730 discloses shows an electric coolant pump for a gas engine heat pump with a pulse-width modulated control signal for a thermostat being supplied to the heat pump controller. The pulse-width modulated signal is generated by the thermostat as a result of the deviation between actual value and setpoint value of the temperature. The document does not disclose any emergency program for the pump in the event of any erroneous value of the signal.

DE 37 38 412 A1 describes a coolant system for an engine with two electric and one mechanical coolant pump. The electrical coolant pumps are controllable by way of an electronic switching device. In the event of any failure of a coolant pump, an emergency running operation is initiated in order to maintain an emergency operation of the engine. In this way it is possible to issue a respective warning signal or to intervene in the engine control for engine operation with reduced output. Closer details on the emergency running operation are not made. It is clearly derived in this connection that the emergency running operation relates to the engine per se and not to individual coolant pumps.

In DE 38 10 174 A1 a device for controlling the coolant temperature of an internal combustion engine is described, with the control of the coolant temperature being effected depending on the load and the speed of the internal combustion engine. There are no instructions given to perform an emergency program for the coolant pump in the event of malfunctions. The specification also does not give any indications to use an error detector for recognising abnormal control signals and operating conditions of the pump.

The practical application of electrically driven coolant pumps shows that irregularities and malfunctions can occur during the operation which can subsequently lead to costly damage requiring repair on the cooling system and the internal combustion engine if not recognized and repaired in due time. After a longer standstill period, jamming of the pump rotor can occur, which in the event of late repair will lead to a mechanical destruction of the electromotor and, consequently, to the thermal overload of the internal combustion engine. On the other hand, in the case of coolant pumps where the electromotor and the pump are arranged as a unit, the rotor shaft is not easily accessible from the outside in order to loosen it by mechanical application of force.

If there is a failure or an erroneous value of the control signal for the electromotor, this can also lead to the failure of the cooling system as a result of a standstill of the pump.

SUMMARY OF THE INVENTION

It is the object of the present invention to avoid such disadvantages and to provide measures against irregularities and malfunctions in the operation of the pump.

This is achieved in accordance with the invention in such a way that the control unit is connected with an error detector for recognizing abnormal control signals and pump operating conditions and with a speed controlling device for the pump speed, with the error detector having an emergency device for the coolant pump.

In this process the control unit determines by way of sensors the amount of heat to be discharged and generates a pulse-width modulated signal for the scheduled speed of the coolant pump depending on the amount of heat to be discharged. The signal is then verified for errors by comparison with a predefined setpoint signal range. On determining an erroneous value in the signal, an emergency program for the coolant pump will be started which ensures a sufficient cooling of the internal combustion engine. If no erroneous value of the signal is determined, the signal is supplied as a setpoint value to the speed controlling device and the rotational speed of the coolant pump will be regulated. These steps will be repeated continuously or in predetermined intervals.

It is preferably provided that the emergency program will provide that the coolant pump will be operated with the rotational speed which allows the highest cooling output in permanent operation. It is advantageous if the emergency device is provided with a short-circuiting circuit for an emergency control signal of the electromotor.

In a particularly preferred embodiment it is provided that the error detector is connected with a Hall sensor on the electromotor-pump unit. The coolant pump is monitored at least during the starting process for jamming, and in the case of jamming, an unjamming program will be activated. It can further be provided that the emergency program provides during dry running and/or mechanical overload of the electromotor that the unit is cut off for a predetermined period of time.

In view of maintenance friendliness, minimization of susceptibility to malfunctions and production expenditure, it is advantageous if the electronic switching circuits for the generation of the control signal on the one part and for the speed control and error detection on the other part are arranged in a spatially separated manner, with preferably the error detector and the speed controlling device being integrated in the electromotor-pump unit.

DESCRIPTION OF THE PREFERRED EMBODIMENT

The invention will now be explained in closer detail by reference to the block diagram which is shown in the FIGURE.

The electromotor 1 of the motor-pump unit 2 which is equipped with protective winding contact is supplied with current I via a gate 3. Gate 3 receives the control voltage V from a speed controlling device 4 which, as a result of a setpoint speed value $n_{soll}$, generates a set voltage value $V_{soll}$. An actual speed value $n_{ist}$ is reported back to speed controlling device 4 via a Hall probe 5. A new correcting variable $V_{soll}$ is formed from the difference between $n_{soll}$ and $n_{ist}$.

The setpoint speed value $n_{soll}$ is determined as a result of pulse-width modulated control signal PWM generated by an electronic control unit 6 having a pulse-width modulator. The control unit 6 can be integrated in the engine management of the internal combustion engine. The control unit 6 calculates the required heat discharge from the motor operation parameters of the internal combustion engine such as coolant temperature, crankshaft speed, cylinder pressure or the like and generates therefrom the pulse-width modulated signal PWM, which is supplied to speed controlling device 4 as a setpoint speed value $n_{soll}$. The signal PWM communicates further with a voltage level 30 (pull-up terminal).

The pulse-width modulated signal PWM, or the setpoint speed value $n_{soll}$ which is determined therefrom, is further supplied to the diagnostic element 7*a* of an error detector 7 which in addition receives the actual speed value $n_{ist}$ from the Hall probe 5 and further, via a by-pass 8 and a digital-to-analogue converter 9, a controlling control voltage $V_k$ as function of the control current I. The error detector 7 verifies in intervals which are predetermined by a clock generator 10 whether there are any errors in the pulse-width modulated signal PWM, in the actual speed value $n_{ist}$ or the control voltage V. The clock generator 10 is initiated and monitored through a monitoring circuit 11 and is supplied via a low-voltage source 12 with power which is connected to the chassis 31 of the vehicle and the terminal 15 (plus pole) of the vehicle.

An emergency device 7*b* of the error detector 7 is in connection with a first short-circuiting actuator 13, which during a failure of the pulse-width modulated signal PWM or in the case of an erroneous signal, will perform an emergency program and will produce a short circuit and will supply the electromotor 1 with the control voltage V which allows the highest cooling output in permanent operation.

Any dry running of the pump is determined through error detector 7 by the by-pass 8 and the digital-to-analogue converter 9 by means of the controlling control voltage $V_k$ depending on the strength of current I by comparison with the engine's voltage regulation characteristic, and in this case the setpoint voltage value $V_{soll}$ is set to equal 0 and engine 1 is run down via the regulator 16 and the actuator 14. Moreover, any jamming of the motor-pump unit 2 will be determined through the emergency device 7*b* of the error detector 7 and the Hall probe 5. In this case an unjamming program is started through the error detector 7 which modifies the control voltage in a suitable manner between a minimum and maximum value in an oscillating way via actuators 13 and 14, so that the motor 1 will generate a sufficiently high unjamming moment. A high unjamming moment is possible particularly in cases when the electromotor 1 is a synchronously running motor. This also simplifies the regulation.

In order to enable simple maintenance and to minimize the production expenditure, at least the speed controlling device 4 and the error detector 7 are integrated in an electronic circuit 17 in the motor-pump unit 2. This allows exchanging the motor-pump unit 2 including the control electronics in one module.

We claim:

1. A method for controlling a coolant pump of an internal combustion engine, the coolant pump being run by an electromotor, with an amount of heat to be discharged being determined from at least one engine operation parameter and a control signal for a scheduled rotational speed of the coolant pump being generated by means of pulse-width modulation depending on the amount of heat to be discharged, including the following steps:

a) determining whether said control signal falls outside of a predetermined setpoint signal range;

b) performing an emergency program for the coolant pump if said signal was determined to have fallen outside the predetermined setpoint signal range in step a) wherein the emergency program provides that a current supplied to the electromotor of the coolant pump causes actuators to open and close, so as to intermittently supply current to said electromotor in the event that the speed measuring device detects no rotation of said electromotor.;

c) adjusting the speed of the coolant pump as a result of the generated signal for the setpoint speed if in step a) said control signal was determined to be within said predetermined setpoint signal range.

2. A method according to claim 1, wherein the steps a) to c) are repeated in predetermined intervals.

3. A method according to claim 1, wherein the emergency program provides that the coolant pump is operated with a speed which allows the highest cooling output in permanent operation.

4. A method according to claim 1, wherein that the emergency program provides that in the case of dry running and/or mechanical overload the electromotor is switched off for a predetermined period of time.

5. An apparatus for controlling operation of an electromotor of a motor-pump unit of an engine which comprises:

a speed-controlling device which delivers a control voltage to a gate so as to supply a controlled current to said electromotor, an electronic control unit which causes a setpoint speed value to be delivered to said speed-controlling device based on an operating parameter of said engine, an error detector which includes a diagnostic element and an emergency device, a speed measuring device connected to said electromotor which delivers an actual speed value to said diagnostic element, said diagnostic element also receiving said setpoint speed value and a controlling control voltage, said emergency device causing said current supplied to said electromotor to be at an operating maximum in the event said diagnostic element detects an erroneous or non-existent setpoint speed value, or causing actuators to open and close so as to intermittently supply current to said electromotor in the event that the speed measuring device detects no rotation of said electromotor.

6. A coolant pump according to claim 5, wherein the electromotor is a synchronously running motor.

7. A coolant pump according to claim 5, wherein the error detector and the speed controlling device are integrated in the motor-pump unit.

8. A coolant pump according to claim 5, wherein said speed measuring device is a Hall probe.

9. A coolant pump according to claim 5, wherein the emergency device comprises a short-circuiting circuit to cause current to be supplied to said electromotor for maximum operation thereof.

10. A coolant pump according to claim 5, wherein the emergency device is provided with a cut-off apparatus which cuts off the electromotor for a predetermined period of time in the case of dry running and/or mechanical overload.

11. A coolant pump according to claim 5, wherein the emergency device is provided with an unjamming circuit which when the coolant pump gets jammed will supply the electromotor with modulated and/or oscillating control signals.

* * * * *